US006314859B1

(12) United States Patent
Weichert et al.

(10) Patent No.: US 6,314,859 B1
(45) Date of Patent: Nov. 13, 2001

(54) SELF-LOADING PISTOL CONVERSION KIT FOR A LOCKED SELF-LOADING PISTOL AND A WEAPON SYSTEM COMPOSED OF AN OPTIONALLY LOCKED OR UNLOCKED SELF-LOADING PISTOL

(75) Inventors: Berthold Weichert, Zimmern; Ernst Mauch, Dunningen; Helmut Weldle, Oberndorf-Beffendorf; Hans-Peter Bantle, Dunningen, all of (DE)

(73) Assignee: Heckler & Koch GmbH (DE)

( * ) Notice: Subject to any disclaimer, the term of this patent is extended or adjusted under 35 U.S.C. 154(b) by 0 days.

(21) Appl. No.: 09/450,621

(22) Filed: Nov. 30, 1999

Related U.S. Application Data

(63) Continuation of application No. PCT/EP98/03213, filed on May 29, 1998.

(30) Foreign Application Priority Data

May 30, 1997 (DE) ..... 197 22 806

(51) Int. Cl.[7] ..... F41A 5/00; F41A 21/00; F41C 5/00

(52) U.S. Cl. ..... 89/199; 89/198; 89/29; 42/1.06

(58) Field of Search ..... 89/29, 163, 196, 89/198, 199; 42/77, 1.06

(56) References Cited

U.S. PATENT DOCUMENTS

| | | | | |
|---|---|---|---|---|
| 1,563,675 | | 12/1925 | Tansley . | |
| 2,522,192 | * | 9/1950 | Porter | 89/198 |
| 2,898,693 | * | 8/1959 | Ruger | 42/77 |
| 3,387,538 | | 6/1968 | Browning | 89/177 |

(List continued on next page.)

FOREIGN PATENT DOCUMENTS

| | | |
|---|---|---|
| 41 09 777 C | 1/1992 | (DE) . |
| 0 287 785 A2 | 10/1988 | (EP) . |

OTHER PUBLICATIONS

PCT *International Search Report* dated Oct. 11, 1998 regarding PCT Patent Application Serial No. PCT/EP98/03213.

*Primary Examiner*—Charles T. Jordan
*Assistant Examiner*—M Thomson
(74) *Attorney, Agent, or Firm*—Marshall, O'Toole, Gerstein, Murray & Borun

(57) ABSTRACT

An unlocked self-loading pistol and a conversion kit for modifying a locked self-loading pistol adapted for firing normal and powerful cartridges into an unlocked self-loading pistol capable of firing weak cartridges as well as normal and powerful cartridges is disclosed. The unlocked self-loading pistol includes a return spring which is closely surrounded on the outside by a sleeve composed of an elastomer material. The length of the elastomer sleeve corresponds approximately to the length of the compressed return spring. The sleeve absorbs a part of the movement energy of the breech and passes it on into the grip. The conversion kit can be used to convert a locked self-loading pistol into an unlocked self-loading pistol as stated above and vice versa. The disclosed conversion kit includes: an alternate barrel which does not come into locked engagement with the breech, the abovementioned elastomer sleeve, and, optionally, a substitute return spring. The locked self-loading pistol and the conversion kit together form a weapon system which can be used to assemble a locked self-loading pistol or an unlocked self-loading pistol, as desired. The unlocked self-loading pistol can fire very lightly filled ammunition and normally filled ammunition without malfunction, and additionally ensures that the breech will withstand the firing of heavily filled ammunition.

27 Claims, 3 Drawing Sheets

U.S. PATENT DOCUMENTS

| | | | | |
|---|---|---|---|---|
| 3,724,326 | | 4/1973 | Day | 89/196 |
| 4,253,377 | | 3/1981 | Arnett | 89/163 |
| 4,514,921 | * | 5/1985 | Burkleca | 42/1 |
| 4,608,909 | * | 9/1986 | Peters | 89/196 |
| 4,707,942 | * | 11/1987 | Peters | 42/77 |
| 4,754,689 | | 7/1988 | Grehl | 89/196 |
| 4,907,362 | * | 3/1990 | Hobble | 42/77 |
| 5,069,110 | * | 12/1991 | Menck | 89/198 |
| 5,309,815 | | 5/1994 | Möller et al. | 89/163 |
| 5,325,617 | * | 7/1994 | Votja et al. | 42/75.03 |
| 5,392,689 | * | 2/1995 | Buzzeo et al. | 89/196 |
| 5,433,134 | | 7/1995 | Leiter | 89/14.5 |
| 5,585,589 | | 12/1996 | Leiter | 89/128 |
| 5,675,106 | | 10/1997 | Leiter | 89/14.5 |
| 5,741,996 | * | 4/1998 | Ruger et al. | 89/196 |

* cited by examiner

SELF-LOADING PISTOL CONVERSION KIT FOR A LOCKED SELF-LOADING PISTOL AND A WEAPON SYSTEM COMPOSED OF AN OPTIONALLY LOCKED OR UNLOCKED SELF-LOADING PISTOL

RELATED APPLICATION

This application is a continuation of International Patent Application Ser. No. PCT/EP98/03213 which was filed on May 29, 1998.

FIELD OF THE INVENTION

The invention relates generally to self-loading firearms and, more particularly to a self-loading pistol, a conversion kit for a locked self-loading pistol, and a weapon system composed of an optionally locked or unlocked self-loading pistol.

BACKGROUND OF THE INVENTION

Self-loading pistols having: (1) a grip; (2) a barrel which is supported firmly on this grip; (3) a breech which is arranged at least partially behind the barrel and moves in the longitudinal direction of the barrel between a front closed position and a rear open position; and (4) a multiple turn, helical return spring which forces the breech into the closed position and, when the breech is in the open position is compressed such that all the turns of the spring are seated on one another are known in the art. For example, such a pistol has been disclosed in German Patent DE 41 09 777 C and is manufactured by HECKLER & KOCH.

Relatively powerful pistol cartridges, (e.g., the 9 mm Parabellum cartridge), are, as a rule, fired from locked self-loading pistols. In these pistols, a locking device generally firmly connects the barrel and the breech to one another such that, when driven by the recoil of a fired cartridge, the barrel and the breech initially travel through a common recoil distance. The breech only separates from the barrel after this common recoil distance has been traversed. After separation, the breech continues through a further recoil movement without the barrel. During this process, the empty cartridge case is ejected, a trigger device is cocked, and the next cartridge is fed.

However, with most of these powerful cartridges, it is also possible to use an unlocked blowback breech if the force of the return spring and/or the mass of the breech are chosen to be sufficiently high. Such blowback breeches are admittedly in widespread use in machine pistols. However, in such weapons, not only the mass but also the kinetic energy of the closing breech are used to support the barrel during firing.

Pistols with a blowback breech which fire cartridges of the type mentioned initially are admittedly known. However, not only is the weight of such pistols heavy overall, but they also have an excessively powerful return spring. Because of this return spring, slide retraction is very tedious and can often be carried out only after sufficient practice. For this reason, only locked pistols are used nowadays for powerful pistol cartridges of the type mentioned initially.

Pistol cartridges of the foregoing type are often available with particularly lightly filled loads. These lightly filled cartridges are used, for example, for sports shooting. This allows the hit result to be optimized, the amount of noise produced to be reduced, the bullet trap to be protected or the cartridge cases to be protected in a very simple manner during reloading, the powder consumption to be reduced, and thus the costs of shooting to be reduced.

Such lightly filled cartridges can also be fired in locked self-loading pistols whose locking devices are adapted to conventional normal ammunition. However, the recoil developed by firing such cartridges is insufficient to achieve reliable slide retraction in such weapons. Normally, the weapons simply remain closed and slide retraction must be carried out by hand after every shot. The pistol with a blowback breech described above also cannot carry out automatic slide retraction when such ammunition is fired because, for example, its breech is too heavy. As a result, firing practices which require a number of shots to be fired quickly cannot be carried out with such weapons and such weak ammunition.

A small caliber retrofitting kit having a small caliber barrel and an unlocked blowback breech adapted to it is known for use in many locked pistols (mostly military pistols). This small caliber barrel and the blowback action can be mounted on the grip of the locked pistol. After installation, one then has a small caliber pistol, which is very similar in handling, trigger weight, etc. to the original locked pistol. Such a pistol is shown, for example, in U.S. Pat. No. 1,563,675. In this known small caliber retrofitting kit, the guide rod for the small caliber closure spring is quite long. Therefore, a buffer sleeve sits on the rear end of this rod. The small caliber closure spring is supported on the front end of this buffer sleeve. Naturally, when retrofitted to a small caliber, this pistol is not suitable for firing a cartridge that can be loaded into the original locked pistol. Even if the unlocked retrofitting system were designed for the same cartridge as the unlocked pistol, one would have to contend with the difficulties that were already described in conjunction with heavy pistols with blowback action.

Cartridges of the abovementioned type (for example 9 mm Parabellum) also exist in a shot version. In this case, they are only lightly filled in order to achieve satisfactory composition of the shot stringing. Such cartridges are often used for defence against snakes by hunters, hikers, lumberjacks etc. in areas where there is a snake hazard. Such a cartridge is normally loaded into the firing chamber of a self-loading pistol while the magazine is loaded with conventional (powerfully filled) bullets. The shot cartridge is then ready for use if a snake is encountered. If, however, instead of a snake, one encounters a relatively large predatory animal, (e.g., a feral dog), then once the shot cartridge has been fired, the slide must be retracted by hand to ready the weapon for defence against the predator. After this first manual retraction, the self-loading pistol can be used in the normal manner.

Only revolvers offer the capability to load shot cartridges and bullets in any desired sequence and to fire them successively without any additional reloading process carried out by hand.

In view of the foregoing, it would be beneficial to provide: (1) a self-loading pistol which is set up to fire the lightly filled cartridges mentioned above; (2) a conversion kit, by means of which a conventional locked self-loading pistol which is set up to fire conventional ammunition, can also be converted to fire the lightly filled ammunition; and (3) a weapon system with a self-loading pistol which can optionally be set up to fire normal or lightly filled anmunition.

Because of the issues mentioned above, in practice, only an unlocked self-loading pistol is suitable for firing the lightly filled cartridges since releasing the lock consumes too much recoil energy so that the subsequent slide retraction process is no longer carried out reliably in a locked self-loading pistol.

To address this issue, it would in principle be possible just to transfer a blowback breech and a return spring force, as are used for light, normally unlocked pocket pistols, to pistols which are normally set up for the larger cartridges mentioned above. Such a measure would admittedly provide a functional pistol. However, if cartridges with a normal charge were accidentally fired from such a pistol, then the breech and the grip would rapidly be damaged at the point where these parts strike one another at the end of the recoil. Such a pistol would quickly become unusable even if it could, perhaps, withstand the firing of this much too powerful ammunition without (parts) breaking.

SUMMARY OF THE INVENTION

In accordance with an aspect of the invention, a self-loading pistol is provided. The self-loading pistol includes a grip; a barrel substantially secured against movement relative to the grip; and a breech located at least partially behind the barrel. The breech is longitudinally movable between a front closed position and a rear open position. The pistol is also provided with a return spring including a plurality of turns and biasing the breech toward the closed position. The return spring operatively engages the breech such that, when the breech is in the open position, the return spring is compressed such that the turns of the return spring are at least largely seated on one another. The return spring has a length when it is compressed. The pistol also includes an elastomer sleeve encircling the return spring. The elastomer sleeve has a length which at least approximately corresponds to the length of the compressed return spring.

In accordance with another aspect of the invention, a kit is provided for converting the locked pistol into an unlocked self-loading pistol. The locked self-loading pistol includes a grip, a breech, a movable barrel which can be releasably locked with the breech, and a return spring. The kit comprises an alternate barrel which can be substantially secured against movement relative to the grip and which cannot lock with the breech. It also includes an elastomer sleeve sized to encircle one of the return spring and a substitute return spring. The sleeve has a length which at least approximately corresponds to a length of the one of the return spring and the substitute return spring when compressed.

In accordance with another aspect of the invention, a weapon system which can form a locked self-loading pistol or an unlocked self-loading pistol is provided. The weapon system comprises a locked self-loading pistol and a kit for reversibly converting the locked self-loading pistol into an unlocked self-loading pistol. The locked self loading pistol includes a grip and a breech located at least partially behind the barrel. The breech is longitudinally movable between a front closed position and a rear open position. The locked self-loading pistol also includes a barrel mounted to the grip for longitudinal movement. The barrel is adapted to releasably lock with the breech when the breech is in the front closed position and to separate from the breech when the breech moves toward the rear open position. Additionally, the locked self-loading pistol is provided with a return spring biasing the breech toward the closed position. The return spring operatively engages the breech such that, when the breech is in the open position, the return spring is compressed. The return spring has a first length when it is compressed. The kit comprises an alternate barrel which can be substantially secured against movement relative to the grip and which cannot lock with the breech. The kit also includes an elastomer sleeve sized to encircle one of the return spring and a substitute return spring. The sleeve has a length which at least approximately corresponds to the length of the one of the return spring and the substitute return spring when compressed.

In accordance with another aspect of the invention, a method is provided for converting a locked self-loading pistol capable of firing cartridges having a charge falling within a first range into an unlocked self-loading pistol capable of firing cartridges having a charge falling within a second range which is larger than, and inclusive of, the first range. The locked self-loading weapon includes a grip. The method comprises the steps of replacing a movable barrel of the locked self-loading pistol with an alternate barrel that is secured against movement relative to the grip; optionally replacing a return spring of the locked self-loading weapon with a substitute return spring; and encircling one of the return spring and the substitute return spring with an elastomer sleeve having a length which at least approximately corresponds to a length of the one of the return spring and the substitute return spring when the one of the return spring and the substitute return spring is compressed.

Other features and advantages are inherent in the disclosed apparatus or will become apparent to those skilled in the art from the following detailed description and its accompanying drawings.

DESCRIPTION OF THE PREFERRED EMBODIMENTS

Figure 1:
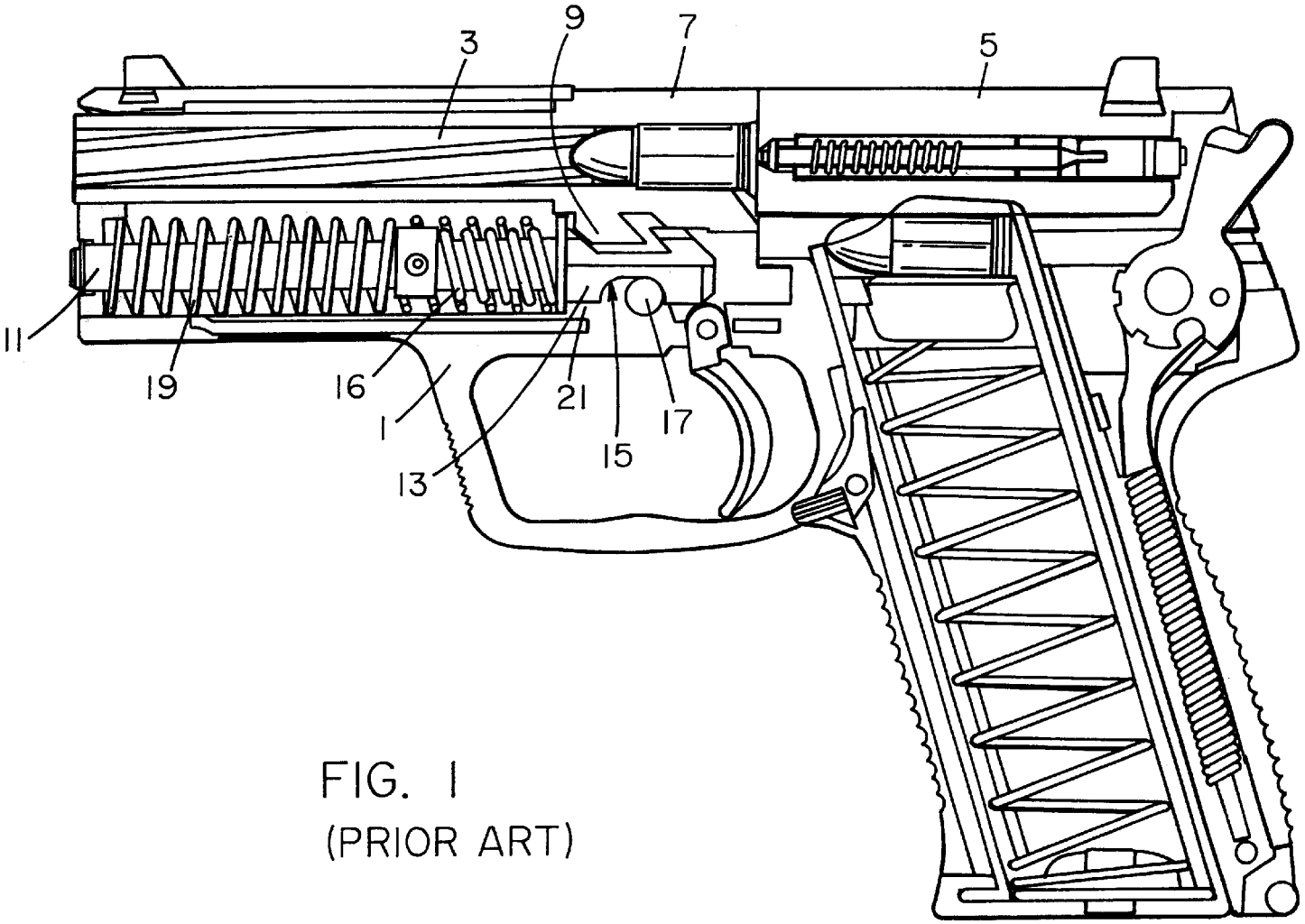
FIG. 1 (PRIOR ART)
FIG. 1 is a longitudinal sectional view of a known, self-loading pistol.

FIG. 1 shows a known locked self-loading pistol which is set up to fire normal, powerful, and very powerful cartridges (e.g., 9 mm Parabellum cartridges). This self-loading pistol has been described in detail in DE 41 09 777 C (HECKLER & KOCH) and Möller et al., U.S. Pat. No. 5,309,815, which are hereby incorporated in their entirety by reference. The following description of this pistol has, therefore, been kept short. Reference is explicitly made to DE 41 09 777 C and U.S. Pat. No. 5,309,815 for a more detailed description of the pistol of FIG. 1.

As shown in FIG. 1, the pistol has a grip 1 composed of plastic, a barrel 3 which is loosely inserted into the grip 1, and a carriage or breech block 5. A locking projection 7 is formed on the top of the rear end of the barrel 3 and, in the locked position shown, engages in the ejection opening (which has no reference number) in the carriage 5, and firmly connects the carriage 5 to the barrel 3.

A guide 9 with oblique surfaces is formed on the undersurface of the rear end of the barrel 3.

The carriage 5 is supported at the front on a return spring 19, which is located around a buffer rod 11. The rear end of the buffer rod 11 is seated under the guide 9. As most easily seen in FIG. 2, the rear end of the buffer rod 11 is designed as a mating guide 13 and, accordingly, has oblique surfaces that are complementary to the oblique surfaces of the guide 9.

The mating guide 13 defines an elongated cut-out 15 on its undersurface. A transverse pin 17 engages with play in this cut-out 15. The transverse pin 17 is attached to the grip 1. The cut-out 15, however, permits the mating guide 13 and the buffer rod 11 to move in a limited manner in the longitudinal direction. For assembly purposes, the transverse pin 17 is attached to the grip 1 such that it can be removed.

A buffer spring 16 forces the buffer rod 11 forward. The buffer spring 16 is seated in a recess defined in the grip 1. This recess is similar to a hole which is open over its length towards the barrel 3. The rear end of the buffer spring 16 is supported on a step 21 formed in the grip 1. The step 21 at least largely surrounds a holder for the rear buffer rod end.

When a shot is fired, the barrel 3 and the carriage 5 initially move together to the rear through a locking distance (about 3.5 mm). During this movement, the two items remain firmly connected to one another by virtue of the engagement of the locking projection 7 in the carriage 5. The oblique surfaces of the guide 9 then run into the mating guide 13 and engage the oblique surfaces of the mating guide 13. The guide 9 is in the process moved obliquely to the rear and downwards. While this movement is taking place, the locking projection 7 is moved downwards such that it releases the carriage 5. The carriage 5 can thus carry out the slide retraction movement in the normal manner (i.e., without attachment to the barrel).

After the guide 9 on the barrel 3 engages in the mating guide 13, it carries the mating guide 13 and, thus, the buffer rod 11, further to the rear against the influence of the buffer spring 16. This joint rearward movement of the barrel 3 and the buffer rod 11 is limited by the front end surface of the cut-out 15 striking against the transverse pin 17.

Figure 2:
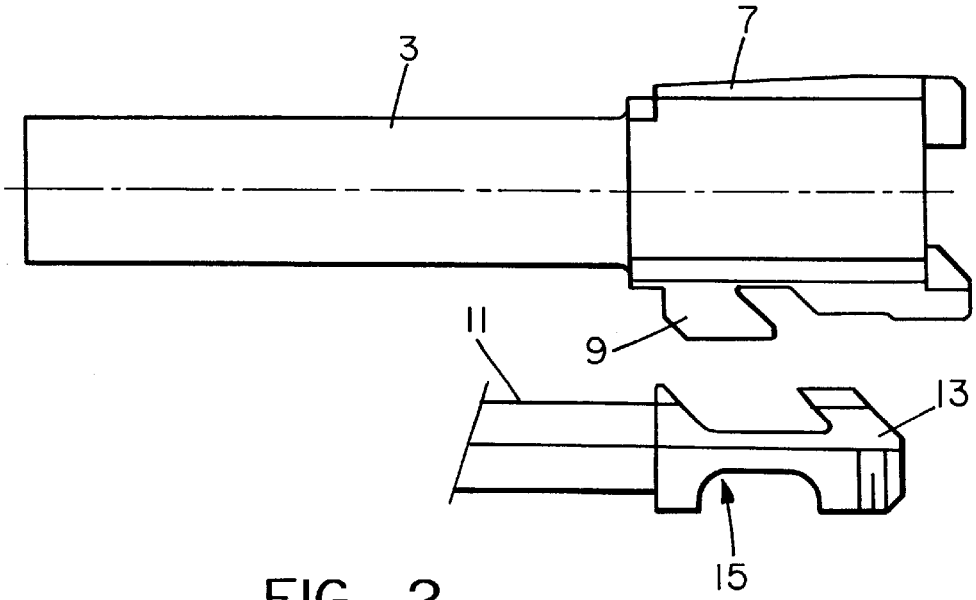
FIG. 2 (PRIOR ART)
FIG. 2 is an enlarged schematic view of the barrel and buffer rod of the self-loading pistol of FIG. 1.

An enlarged view of the barrel 3 and the buffer rod 11 is provided in FIG. 2. The return spring 19 and the buffer spring 16 have been omitted from that view for enhanced clarity.

Figure 3:
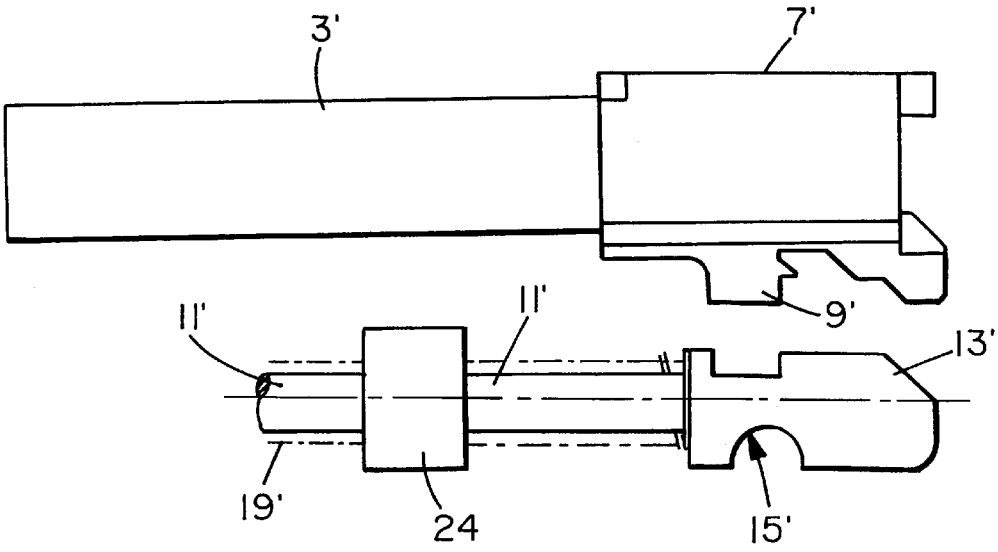
FIG. 3 illustrates the alternate barrel and the substitute buffer rod with an elastomer sleeve of a conversion kit constructed in accordance with the teachings of the invention for converting the pistol of FIG. 1 into an unlocked self-loading pistol.
Figure 4:
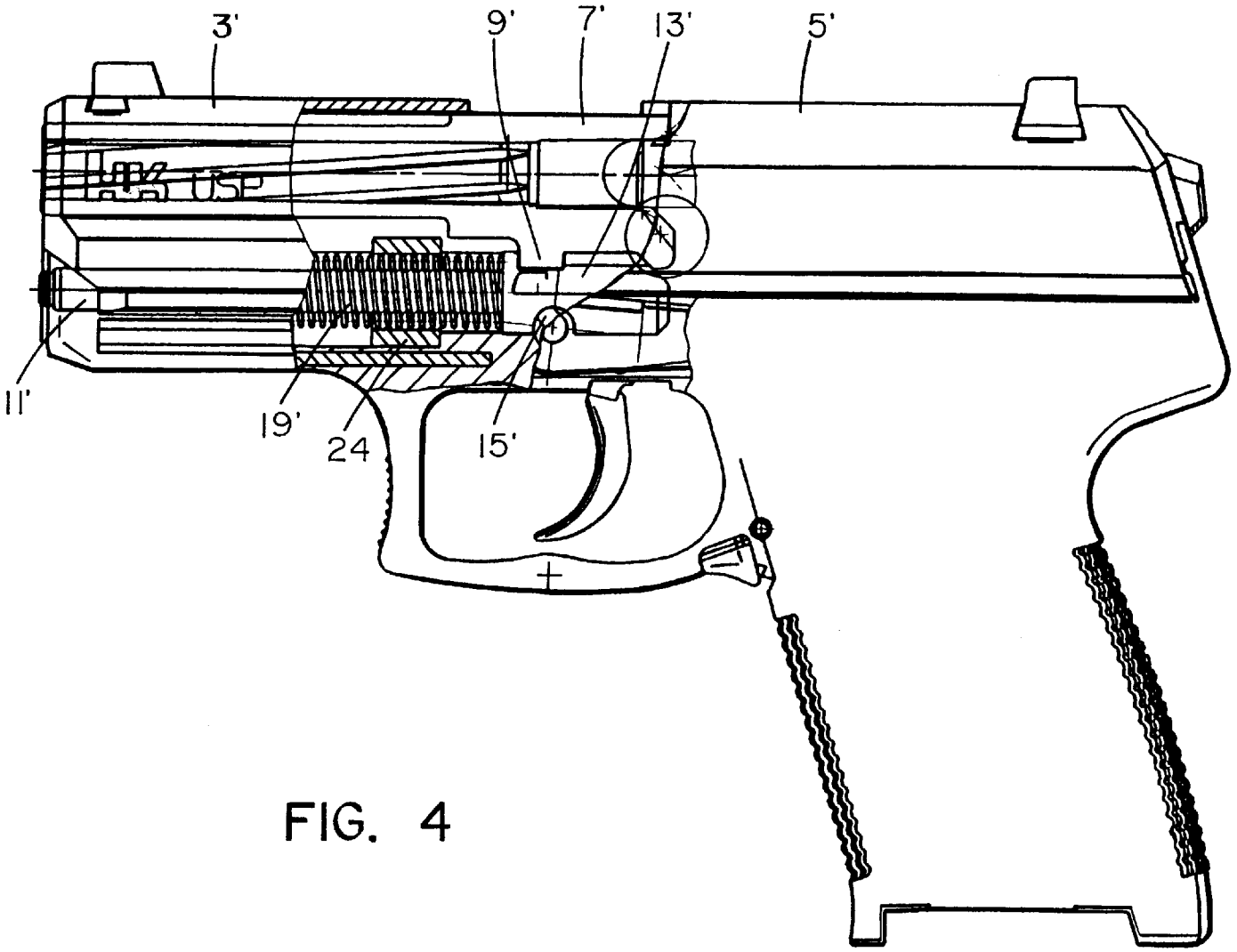
FIG. 4 is a longitudinal sectional view of the pistol of FIG. 1 employing the conversion kit of FIG. 3.

FIG. 3 illustrates a conversion kit constructed in accordance with the teachings of the invention. The conversion kit of FIG. 3 is adapted for use in the pistol of FIG. 1. The elements of FIG. 3 are shown in the same scale as the elements in FIG. 2 for ease of comparison. As shown in FIG. 3, the conversion kit comprises an alternate barrel 3', a substitute buffer rod 11', a substitute return spring 19' and an elastomer sleeve 24.

If FIGS. 2 and 3 are compared, the differences between the components of the conversion kit and the known original parts of the pistol of FIG. 1 are immediately evident. The parts of the conversion kit can in this way easily be distinguished from the original parts of the known self-loading pistol in FIGS. 1 and 2. In FIG. 3, all of the reference numbers provided with an index denote those parts of the conversion kit which have been modified from the original parts with the same reference number, but without an index.

The locking projection 7 on the original barrel 3 is missing at the rear end of the alternate barrel 3'. Instead of the projection 7, there is a flattened region 7'. It is, thus, impossible for any locking engagement to occur between the barrel 3' and the carriage 5. The engagement projection 9' and the mating projection 13' are designed and seated in one another such that it is no longer possible for them to move relative to one another. In addition, the recess 15' is matched to the contour of the transverse pin 17 (see FIG. 1) to form a pin holder, so that the buffer rod 11' cannot move in the longitudinal direction relative to the grip 3.

Once the alternate barrel 3' has been assembled with the grip 1 and the carriage 5 of the self-loading pistol of FIG. 1, it is firmly seated in the grip 1. In particular, its engagement projection 9' is firmly seated in the mating projection 13' on the buffer rod 11'. The recess 15' of the buffer rod 11' is also firmly seated on the transverse pin 17. Thus, neither the rod 11' nor the barrel 3' can move with respect to the grip 1.

An elastomer sleeve 24 closely encircles the substitute return spring 19' on the outside. The sleeve 24 is initially located at any point within the longitudinal extent of the spring 19'. This return spring 19' is formed from strip steel, so that its individual turns are seated flat on one another when the substitute return spring 19' is completely compressed. The elastomer sleeve 24 can be made of rubber or the like. For example, in the preferred embodiment, the sleeve 24 is made of Ultramid B3K which is manufactured by BASF (Badische Anilin-und Sodafabriken) of Germany.

During firing, although the carriage 5 moves to the rear, the alternate barrel 3' does not move because the barrel 3' is locked in its position. As a result, the carriage 5 compresses the substitute return spring 19' and pushes the elastomer sleeve 24 to the rear into the hole (described further above) in the grip 1. At the end of the recoil of the carriage 5, all the turns of the substitute return spring 19' are compressed, and the carriage 5 is preferably simultaneously seated on the compressed substitute return spring 19' and the elastomer sleeve 24. The elastomer sleeve 24, for its part, is seated on the step 21 of the grip 1, which surrounds the holder for the buffer rod 11 or 11'.

The elastomer sleeve 24 is driven upward and frictionally engages both the inner wall of the hole and the outer surface of the compressed substitute return spring 19'. At the same time, the forces which have been introduced by the carriage 5 are passed by the elastomer sleeve 24 over a large area via the inner wall of the hole and the step 21 into the grip 1. At the same time, a proportion of these forces is also passed on via the compressed return spring 19' and the buffer rod 11' into the transverse pin 17 and, via it, into the grip 1.

As stated, the unlocked modification of the self-loading pistol is obtained by assembling the parts shown in FIG. 3 with the other parts, in particular the grip 1 shown in FIG. 1. If an extremely powerful cartridge is accidentally fired with this recoilless pistol, then the carriage 5 will admittedly be opened very quickly and may possibly bounce back again very quickly. However, in no case does the carriage 5, and, in particular, the grip 1, suffer any damage. Specifically, the recoil energy is damped and passed on over a large area into the grip 1 which, for its part (since it is composed of plastic) passes on the impact "more softly" than, for example, a grip composed of hardened steel.

Furthermore, the modified, recoilless self-loading pistol disclosed herein is automatically reloaded flawlessly when weak cartridges (including shot cartridges) are fired, in the same way as when normal charges are fired.

The alternate barrel 3' is preferably (although optionally) colored conspicuously, at least in its flattened region 7'. As a result, the person firing the weapon is made aware that the weapon has been modified as described above just by looking at the pistol, even if he has already aimed.

It should also be mentioned that in the preferred embodiment the following procedures are evidently impossible. For example, it is not possible to utilize only the alternate barrel 3' but not the other parts in FIG. 3 or, in other words, to utilize the alternate barrel 3' with the corresponding other parts of FIG. 2. Also, the elastomer sleeve 24 cannot be erroneously omitted since it is fitted in a captive manner on the buffer rod 11', together with the substitute return spring 19'.

The self-loading pistol shown in FIG. 1 and the alternate parts (i.e., the conversion kit) shown in FIG. 3 together form a weapon system constructed in accordance with the teachings of the invention. In this system, the weight of the carriage 5 can be optimized in comparison with the weight of the carriage of the conventional pistol shown in FIG. 1, if required.

As mentioned above, the return spring 19' is closely surrounded on the outside by a sleeve 24 composed of an elastomer material. The elastomer sleeve 24 has a length which corresponds approximately to the length of the compressed return spring 19' at the end of the breech recoil.

The breech weight and the force of the return spring 19' are selected such that the weapon operates correctly with the lightly filled cartridges discussed above. The buffer arrangement formed from the elastomer sleeve 24 and the compressed return spring 19' is not required when the weapon is used with this type of ammunition. If, however, a powerful cartridge is loaded accidentally, then the breech (carriage) will strike against the turns of the return spring 19' that are seated on one another and against the elastomer sleeve 24. The elastomer sleeve 24 thus produces a first buffering effect.

Elastomer buffers for damping the end strike of a breech against the grip of a self-loading pistol have already been disclosed (EP-A-0 287 785). However, the elastomer sleeve 24 disclosed herein also has a further, major effect. Specifically, if the mainspring 19' is severely loaded when its turns are seated on one another, (for example, if an excessively powerful cartridge is fired), then the turns will try to twist out from one another at the sides. This is scarcely possible in the disclosed weapon, since the elastomer sleeve 24 supports the turns at the sides. However, depending on its stiffness, the elastomer material flexes slightly in position in response to any lateral pressure from turn elements, so that elements of the elastomer are then deflected resiliently in places. This deflection takes place in interaction with compression of the elastomer sleeve 24 and may be significant in places. Owing to the hysteresis effect of the chosen elastomer, recoil energy is in this way absorbed to a considerable extent, so that the damping effect of such an elastomer sleeve 24 is considerably better than, for example, that of a stiff additional spring. In addition, the spring effect of the completely compressed return spring 19' is not, as in the past, dependent on tolerances. The lateral support of the return spring 19' means, specifically, that its spring effect in the fully compressed state is exactly reproducible.

The length of the elastomer sleeve 24 determines when its damping effect comes into play. The elastomer sleeve 24 may be longer than the completely compressed return spring 19'. Its optimum length is determined during optimization of the weapon. The optimum hardness and hysteresis effect of the elastomer sleeve 24 are governed by the material choice.

It is possible to fire cartridges of a very much greater range of performance variations with the disclosed self-loading pistol than has heretofore been possible with known locked and unlocked self-loading pistols. For example, the disclosed weapon can fire cartridges that are so weak that, until now, it has scarcely been possible to fire them in locked pistols, as well as cartridges that are so powerful that it has until now been necessary to equip unlocked pistols with excessively powerful return springs to permit discharge of such ammunition. Discharge of cartridges with strengths in between these two examples is, of course, also possible with the disclosed weapon.

Only in the case of extremely powerful cartridges, (for example, in the case of military ordnance cartridges which are designed for machine pistols), is it not always completely possible to preclude misfeeds when the disclosed self-loading pistol is set up to fire the abovementioned weak cartridges. However, firing even these extremely powerful cartridges does not lead to any damage to the disclosed pistol.

With the disclosed pistol, it is now for the first time possible to fire both weak target-practice charges or shot cartridges as well as normal charges without any malfunctions. Until now, this flexibility has only been available with revolvers. The ability to use a range of ammunition can be beneficial in many instances. For example, in the self-defence context, (for example against intruders), a non-lethal shot can first be fired as a warning shot (deterrent effect), then, if the attacker does not respond as desired to this warning, a "live" shot can be fired (stopping effect). In another context, a hunter may now, for example, provide two shot cartridges for attacking snakes, and fill the rest of the magazine with normal cartridges. Shot and "normal" cartridges can be loaded alternately, without any stipulation as to the cartridge type. If, for example, the hunter is approached by a wounded wild boar then, as in the case of a revolver, he just needs to fire the two shot cartridges and can then make use of the weapon against the wild boar with the remaining normal cartridges. For self-defence, a shot cartridge can, for example, be loaded as the first cartridge for a deliberate warning shot which does not cause significant injuries. However, in principle, cartridges of the types described above can be loaded in any desired sequence and can be fired without any malfunctions, irrespective of their type or the selected sequence.

Compared to a revolver, which normally has only six shots available, the disclosed self-loading pistol has the advantage of carrying a much greater number of rounds in the magazine, (for example, fifteen shots). In addition, another magazine can be fitted as often as desired later, with few actions involved. Finally, magazines with special cartridges can be kept available in case they are needed.

As usual, the return spring 19' can be wound from a wire with a round cross-section to form a helical compression spring with a round external circumference. However, the return spring 19' is preferably formed from a spring-steel strip so that the individual turns are seated flat on one another when the spring 19' is compressed. The risk of the individual turns escaping at the sides when the return spring 19' is completely compressed is in this way reduced, but is not overcome. The elastomer sleeve 24 can thus be loaded transversely with respect to its axis, even when the return spring 19' is completely compressed to ensure that none of the spring turns escape. Such a spring 19' has been found to be particularly advantageous in other respects since it can be subjected to a high level of overloading without being damaged in the process.

A cup spring pack may also be regarded as a helical compression spring for the purposes of the invention.

Preferably, the elastomer sleeve 24 is seated in a hole in the grip 1 when the return spring 19' is compressed. The seating hole supports the elastomer sleeve 24 on the outside and, in the process, influences its deformation characteristics. This hole does not need to have an internal wall extending over its entire circumference but may, for example, be open toward the barrel or be slotted. Providing such an opening or slot advantageously prevents the enclosure of an uncontrolled air cushion which could influence the effect of the elastomer sleeve 24 in an unpredictable manner.

Not only has an unlocked self-loading pistol as described above been disclosed, but a kit for converting a locked self-loading pistol which can fire normal cartridges and powerful cartridges but not weak cartridges into a pistol that can fire a wider range of cartridges has also been described. The conversion kit allows the locked self-loading pistol to be converted into an unlocked self-loading pistol which can fire cartridges of the same size, but of considerably less power. If required, the weak cartridges can be mixed in the magazine with normal cartridges as explained above. It is, thus, possible to use the same weapon and, in particular, a trigger characteristic that is always the same, to fire cartridges of all possible filling levels in the self-loading mode. This self-loading capability is even present when firing the weak charges mentioned above which, until now, when fired from locked pistols of equivalent calibre have required manual slide retraction (i.e., loading) after each shot.

As explained above, the conversion kit is particularly well suited for use with a locked self-loading pistol which has a grip, a moving barrel which can be moved into firm connection with the breech, and a helical return spring. As also explained above, this pistol can be converted by substituting an alternate barrel 3' which can be fitted firmly in the grip 1 without engaging in the breech 5 for the conventional barrel 3, and by utilizing an elastomer sleeve 24 which closely encloses the return spring 19' from the outside. If desired, the length of the sleeve 24 corresponds approximately to the length of the compressed return spring 19'. Preferably, the return spring 19 of the locked self-loading pistol is also replaced by a substitute return spring 19' having a different characteristic.

Preferably, the breech 5 is retained during the conversion process. However, it is also possible to provide a substitute breech 5' whose mass differs from that of the original breech 5.

Although the above description speaks of substituting one "barrel 3'" for another "barrel 3", persons of ordinary skill in the art will appreciate from the foregoing description that the substitution typically involves exchanging an entire "barrel assembly" which, in addition to the actual barrel, also includes elements of the locking device associated with it for another barrel assembly with different locking elements. However, where the actual barrel can be separated from the elements of the locking device, it is possible to retain the actual barrel during the conversion and only change the locking parts without departing from the scope or spirit of the invention.

Furthermore, the elastomer sleeve 24 requires a space to be available all round the return spring 19' in order to accommodate the elastomer sleeve 24. Therefore, a grip which by virtue of its design does not provide any space to accommodate the elastomer sleeve 24 cannot be converted but must instead be replaced with a suitable grip. Alternatively, the grip can be structurally modified so as to provide an accommodating space for the sleeve 24 when used.

It is preferable to retain at least the grip 1 with the trigger device and, as far as possible, the aiming device as well for both the locked and the unlocked (i.e., converted) version of the self-loading pistol.

As mentioned above, a locked self-loading pistol which is particularly suitable for conversion has been disclosed in German Patent DE 41 09 777 C. In this pistol, the barrel (which moves in the longitudinal direction) has on the top of the cartridge chamber end an attachment which engages in a holder in the carriage (this is the breech). A guide is formed at the rear end of the barrel, underneath the cartridge chamber, and, during rearward movement of the barrel, engages in mating elements on the grip such that the rear end of the barrel is moved downwards as the rearward movement of the barrel continues. In this way, the breech is separated from the barrel and can move further to the rear on its own.

This attachment between the carriage 5 and the barrel 3 is not present in the alternate barrel 3'. As a result, the breech 5 can never engage in a locked manner with the barrel 3'. Furthermore, the guide is set up to be held firmly in the grip 1, so that, when assembled, the barrel 3' cannot move relative to the grip 1.

In the case of some pistols, a hinged link through which a transverse bolt passes is mounted on the barrel as a guide. This hinged link must be replaced by a rigid link to convert the pistol as taught by this disclosure.

In other known pistols, the guide is formed by a guide surface which slides along a transverse bolt. This guide surface must be replaced by an opposing bearing, which is firmly retained in the transverse bolt to convert these pistols as taught by this disclosure. This locking system is similar to that of the pistol in the abovementioned patent DE 41 09 777 C. In the DE 41 09 777 C reference, however, the guide surface slides along an opposing formation of a moving buffer rod 11 which, for its part, is used as a guide rod for the return spring 19 and, furthermore, has an additional buffer spring 16. As explained above, this buffer rod 11 is replaced by a substitute buffer rod 11' which, for its part, can be mounted in the grip 1 such that it does not move and in which the guide surface is fixed such that it also does not move. Since this substitute buffer rod 11' does not carry out any buffer movement, it also has no buffer spring. Instead of such a spring, the substitute return spring 19' extends over the entire length of the buffer rod 11' and is fitted on its outside with the elastomer sleeve 24 described above.

The original known buffer rod 11 has an elongated cut-out 15 which can slide along in the grip 1 above a fixed-position transverse pin 17. This pin 17 can be removed to dismantle the weapon. Nonetheless, when assembled, the cut-out 15 and pin 17 cooperate to limit the longitudinal movement of the rod 11. As discussed above, the substitute buffer rod 11' also has a cut-out 15'. However, this cut-out 15' is not elongated but is instead designed to be complementary to the transverse pin 17. Consequently, the rod 11' is held in a fixed position by the pin 17.

Depending on the design of the locked self-loading pistol, the barrel 3, 3' is visible to a greater or lesser extent from the outside. This is true at least of that surface region of the barrel 3, 3' which, when the carriage 5 is closed, is visible through the ejection opening provided in the carriage 5. As a rule, the barrel 3 is blued, but sometimes is alternately bare, nickel-plated, bonderized or gold-plated. At the same time, if the visible barrel surface is not bare, its color generally corresponds to the color of the carriage surface. Furthermore, this visible barrel surface is, as a rule, smooth.

To facilitate identification of a converted weapon, the alternate barrel 3' in the conversion kit preferably has a surface which differs from that of the original barrel 3 and which contrasts as much as possible with that of the carriage 5. For example, the substitute barrel 3' can be knurled, blued, electro-plated with non-ferrous metal or painted. The purpose of this refinement is to give the person firing the weapon an indication (which is always visible and preferably, can also be felt to some extent) that the weapon has actually been converted to fire weak cartridges and is unlocked.

It has astoundingly been found that the loads which occur on all the stressed parts when a powerful cartridge is accidentally fired from the unlocked (i.e., converted) weapon are considerably less if a grip composed of plastic is used instead of a steel grip. Presumably, the plastic material of the grip reinforces the damping effect of the arrangement comprising the compressed substitute return spring 19' and the elastomer sleeve 24.

As mentioned above, the self-loading pistol and the conversion kit described above may be sold together to provide a weapon system. The self-loading pistol may be modified, if necessary, to match the conversion kit. For example, the breech weight may be optimized such that it ensures the best results for both the unlocked and the locked version of the self-loading pistol.

Although certain apparatus constructed in accordance with the teachings of the invention have been described herein, the scope of coverage of this patent is not limited thereto. On the contrary, this patent covers all embodiments of the teachings of the invention fairly falling within the scope of the appended claims either literally or under the doctrine of equivalents.

What is claimed is:

1. A self-loading pistol comprising:

a grip;

a barrel substantially secured against movement relative to the grip;

a breech located at least partially behind the barrel, the breech being longitudinally movable between a front closed position and a rear open position;

a return spring including a plurality of turns and biasing the breech toward the closed position, the return spring operatively engaging the breech such that, when the breech is in the open position, the return spring is compressed such that the turns of the return spring are at least largely seated on one another, the return spring having a length when it is compressed; and an elastomer sleeve encircling the return spring, the elastomer sleeve having a length which at least approximately corresponds to the length of the compressed return spring.

2. A self-loading pistol as defined in claim 1 wherein the return spring comprises a flat strip having a substantially rectangular cross-section with a pair of long sides and a pair of short sides, and wherein, when the return spring is compressed, the long sides of the cross-section are seated on one another.

3. A self-loading pistol as defined in claim 1 wherein the elastomer sleeve is seated in a hole defined in the grip.

4. A self-loading pistol as defined in claim 1 further comprising a buffer rod in engagement with the grip to secure the buffer rod against movement, the buffer rod engaging the barrel to secure the barrel against movement relative to the grip.

5. For use with a locked self-loading pistol including a grip, a breech, a movable barrel which can be releasably locked with the breech, and a return spring, a kit for converting the locked pistol into an unlocked self-loading pistol, the kit comprising:

an alternate barrel which can be substantially secured against movement relative to the grip and which cannot lock with the breech; and an elastomer sleeve sized to encircle one of the return spring and a substitute return spring, the sleeve having a length which at least approximately corresponds to a length of the one of the return spring and the substitute return spring when compressed.

6. A conversion kit as defined in claim 5 wherein the one of the return spring and the substitute return spring comprises a flat wire having a rectangular cross-section with a pair of long sides and a pair of short sides, and wherein, when the one of the return spring and the substitute return spring is compressed, the long sides of the cross-section are seated on one another.

7. A conversion kit as defined in claim 5 further comprising a substitute breech having a mass different from the mass of the breech.

8. A conversion kit as defined in claim 5 wherein the barrel of the locked self-loading pistol has at least one locking projection which engages in a carriage comprising the breech to releasably lock the barrel to the breech, wherein the barrel has a guide which facilitates movement of the barrel to the rear and downward through a locking distance to thereby release the breech from the barrel when a shot is fired, wherein the alternate barrel has a continuous surface which cannot engage the carriage and thus cannot lock the barrel to the breech, and wherein the alternate barrel also has an engagement projection to secure the alternate barrel against movement relative to the grip.

9. A conversion kit as defined in claim 8 wherein the self-loading pistol has a buffer rod which is located under the barrel, which can move longitudinally relative to the grip, which passes through and supports the return spring and a buffer spring, and which is designed to engage the guide of the barrel; and wherein the kit further comprises a substitute buffer rod carrying the substitute return spring, the substitute buffer rod being securable in the grip such that the substitute buffer rod does not move longitudinally relative to the grip, the substitute buffer rod being structured to engage in the engagement projection of the alternate barrel to secure the alternate barrel against movement relative to the grip.

10. A conversion kit as defined in claim 8 wherein the self-loading pistol has a buffer rod which includes an elongated cut-out through which a removable transverse pin passes, and wherein the kit further comprises a substitute buffer rod that has a pin holder which is complementary to the transverse pin.

11. A conversion kit as defined in claim 5 wherein the alternate barrel has at least one of a color and a surface formation which differs from a corresponding one of a color and a surface formation of the barrel at least in a region of its outer surface which is visible from the outside of the pistol.

12. A conversion kit as defined in claim 11 wherein the region is visible through an ejection opening of the breech.

13. A weapon system which can form a locked self-loading pistol or an unlocked self-loading pistol comprising:

a locked self-loading pistol including:

(a) a grip;

(b) a breech located at least partially behind a barrel, the breech being longitudinally movable between a front closed position and a rear open position;

(c) the barrel mounted to the grip for longitudinal movement, the barrel being adapted to releasably lock with the breech when the breech is in the front closed position and being adapted to separate from the breech when the breech moves toward the rear open position; and (d) a return spring biasing the breech toward the closed position, the return spring operatively engaging the breech such that, when the breech is in the open position, the return spring is compressed, the return spring having a first length when it is compressed; and a kit for reversibly converting the locked self-loading pistol into an unlocked self-loading pistol, the kit including:

(1) an alternate barrel which can be substantially secured against movement relative to the grip and which cannot lock with the breech; and (2) an elastomer sleeve sized to encircle one of the return spring and a substitute return spring, the sleeve having a length which at least approximately corresponds to the length of the one of the return spring and the substitute return spring when compressed.

14. A weapon system as defined in claim 13 wherein the locked self-loading weapon and the unlocked self-loading weapon utilize a common grip.

15. A weapon system as defined in claim 14 wherein the grip comprises plastic.

16. A weapon system as defined in claim 13 wherein the one of the return spring and the substitute return spring comprises a flat strip having a substantially rectangular cross-section with a pair of long sides and a pair of short sides, and wherein, when the one of the return spring and the substitute return spring is compressed, the long sides of the cross-section are seated on one another.

17. A weapon system as defined in claim 13 wherein, when the unlocked self-loading pistol is assembled, the elastomer sleeve is seated in a hole defined in the grip.

18. A weapon system as defined in claim 13 wherein the locked self-loading weapon further comprises a buffer rod, and the kit further comprises a substitute buffer rod which is adapted to engage the grip to secure the substitute buffer rod against longitudinal movement relative to the grip, the substitute buffer rod and the alternate barrel being adapted to engage one another to secure the barrel against movement relative to the grip.

19. A weapon system as defined in claim 13 wherein the unlocked self-loading pistol can fire cartridges having a first minimum charge and still properly self-load, the locked self-loading pistol can fire cartridges having a second minimum charge and still properly self-load, and the first minimum charge is smaller than the second minimum charge.

20. A weapon system as defined in claim 19 wherein the locked self-loading pistol can fire cartridges having a charge falling within a first range of charges, and the unlocked self-loading pistol can fire cartridges having a charge falling within the first range of charges without suffering damage.

21. A weapon system as defined in claim 19 wherein the locked self-loading pistol can fire cartridges having a charge falling within a first range of charges, wherein the unlocked self-loading pistol can fire cartridges having a charge falling within a second range of charges, wherein the second range is larger than the first range, and wherein the second range is inclusive of the first range.

22. A weapon system as defined in claim 13 wherein the kit further comprises a substitute breech having a mass different from the mass of the breech of the locked self-loading weapon.

23. A weapon system as defined in claim 13 wherein the locked self-loading pistol has a buffer rod which is located under the barrel, which can move longitudinally relative to the grip, which passes through and supports the return spring, and which is designed to engage the barrel; and wherein the kit further comprises a substitute buffer rod carrying the substitute return spring, the substitute buffer rod being securable in the grip such that the substitute buffer rod does not move longitudinally relative to the grip, the substitute buffer rod being structured to engage the alternate barrel to secure the alternate barrel against movement relative to the grip.

24. A weapon system as defined in claim 13 wherein the alternate barrel has at least one of a color and a surface formation which differs from a corresponding one of a color and a surface formation of the barrel of the locked self-loading pistol at least in a region of an outer surface which is visible from the outside of the pistol.

25. A weapon system as defined in claim 24 wherein the region is visible through an ejection opening of the breech.

26. A method of converting a locked self-loading pistol capable of firing cartridges having a charge falling within a first range into an unlocked self-loading pistol capable of firing cartridges having a charge falling within a second range which is larger than, and inclusive of, the first range, the locked self-loading weapon including a grip, the method comprising the steps of:

replacing a movable barrel of the locked self-loading pistol with an alternate barrel that is secured against movement relative to the grip;

optionally replacing a return spring of the locked self-loading weapon with a substitute return spring; and encircling one of the return spring and the substitute return spring with an elastomer sleeve having a length which at least approximately corresponds to a length of the one of the return spring and the substitute return spring when the one of the return spring and the substitute return spring is compressed.

27. A method as defined in claim 26 wherein the step of replacing the return spring further comprises the step of replacing a buffer rod of the locked self-loading pistol with a substitute buffer rod carrying the substitute return spring, and the step of replacing the barrel further comprises the steps of securing the substitute buffer rod to the grip and securing the alternate barrel to the substitute buffer rod to secure the alternate barrel against movement relative to the grip.

* * * * *